US007252080B2

(12) United States Patent
Yeh

(10) Patent No.: US 7,252,080 B2
(45) Date of Patent: Aug. 7, 2007

(54) PAINTBALL GUN LOADING DEVICE

(75) Inventor: Ken-chin Yeh, Yung Kang (TW)

(73) Assignee: Sunworld Industrial Co., Ltd., Tainan Hsien (TW)

( * ) Notice: Subject to any disclaimer, the term of this patent is extended or adjusted under 35 U.S.C. 154(b) by 143 days.

(21) Appl. No.: 11/028,640

(22) Filed: Jan. 5, 2005

(65) Prior Publication Data

US 2005/0217654 A1 Oct. 6, 2005

(30) Foreign Application Priority Data

Mar. 12, 2004 (TW) ..... 93203739 U

(51) Int. Cl.
*F41F 1/00* (2006.01)

(52) U.S. Cl. ..... 124/82; 124/51.1

(58) Field of Classification Search ..... 124/49, 124/51.1, 82

See application file for complete search history.

(56) References Cited

U.S. PATENT DOCUMENTS 5,383,442 A * 1/1995 Tippmann ..... 124/76
2003/0213481 A1* 11/2003 Bell ..... 124/56
2004/0000300 A1* 1/2004 Ho ..... 124/49
2005/0284456 A1* 12/2005 Chipley ..... 124/51.1
2006/0032488 A1* 2/2006 Telford ..... 124/82

OTHER PUBLICATIONS

Action Pursuit Games, Apr. 2001, Chipley Angel Low Rise Feed Port, 2 pages.* pbreview.com/2426/, retrieved Dec. 9, 2006, Chipley Custom Machine Feedneck, 7 pages.* pbreview.com/2430/, retrieved Dec. 9, 2006, Chipley Custom Machine Feedneck, 5 pages.*

* cited by examiner

*Primary Examiner*—Troy Chambers
(74) *Attorney, Agent, or Firm*—Rosenberg, Klein & Lee

(57) ABSTRACT

A paintball gun loading device includes a gun body, a loading member and a funnel. The loading member comprises a fixture at an upper portion thereof. The fixture comprises a circular trough with a plurality of slots along the circular trough. A clamp sleeved on the circular trough is tightened with a quick-release rod and a nut to fasten the funnel in a different size.

1 Claim, 5 Drawing Sheets

PAINTBALL GUN LOADING DEVICE

BACKGROUND OF THE INVENTION

1. Field of the Invention

This invention relates to a paintball gun loading device, and more particularly to a paintball gun able to replace with different sizes of funnels in a quick and easy manner.

2. Description of the Prior Art

There are various paintball guns on the market, and the loading methods are different with each other. One conventional paintball gun A, as shown in FIG. 5, comprises an opening A2 at the top of a barrel A1, and a pair of threaded holes A3 at respective sides of the opening A2. The threaded holes A3 are inserted with a pair of screws A4 to secure protruding plates B1 of a loading member B. The loading member B comprises a loading opening B2 on top thereof to connect with a fixing end C1 of a funnel C. This design allows the paintball to drop into the barrel A1 and wait for shooting. The connection between the loading member B and the gun A may cause loosening or misalignment, thus it has to be adjusted all the time.

SUMMARY OF THE INVENTION

It is the primary objective of the present invention to provide a paintball gun loading device, which is easy and quick to install.

It is another objective of the present invention to provide a paintball gun loading device, which guides paintball to drop into a barrel in an accurate way.

It is a further objective of the present invention to provide a paintball gun loading device, which saves a lot of time to replace different loading members.

DETAILED DESCRIPTION OF THE PREFERRED EMBODIMENT

Figure 1:
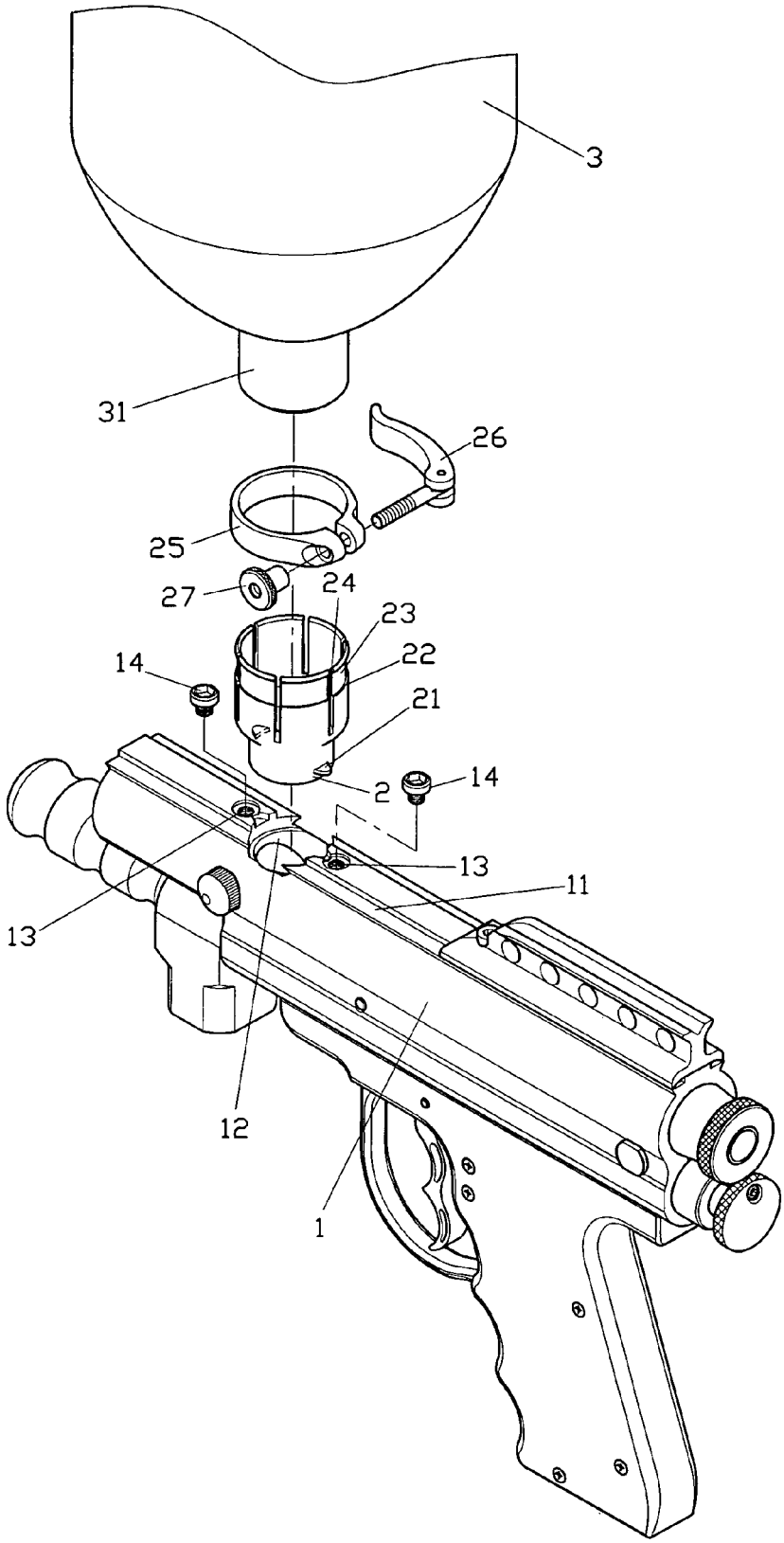
FIG. 1 is an exploded view of the present invention.
Figure 2:
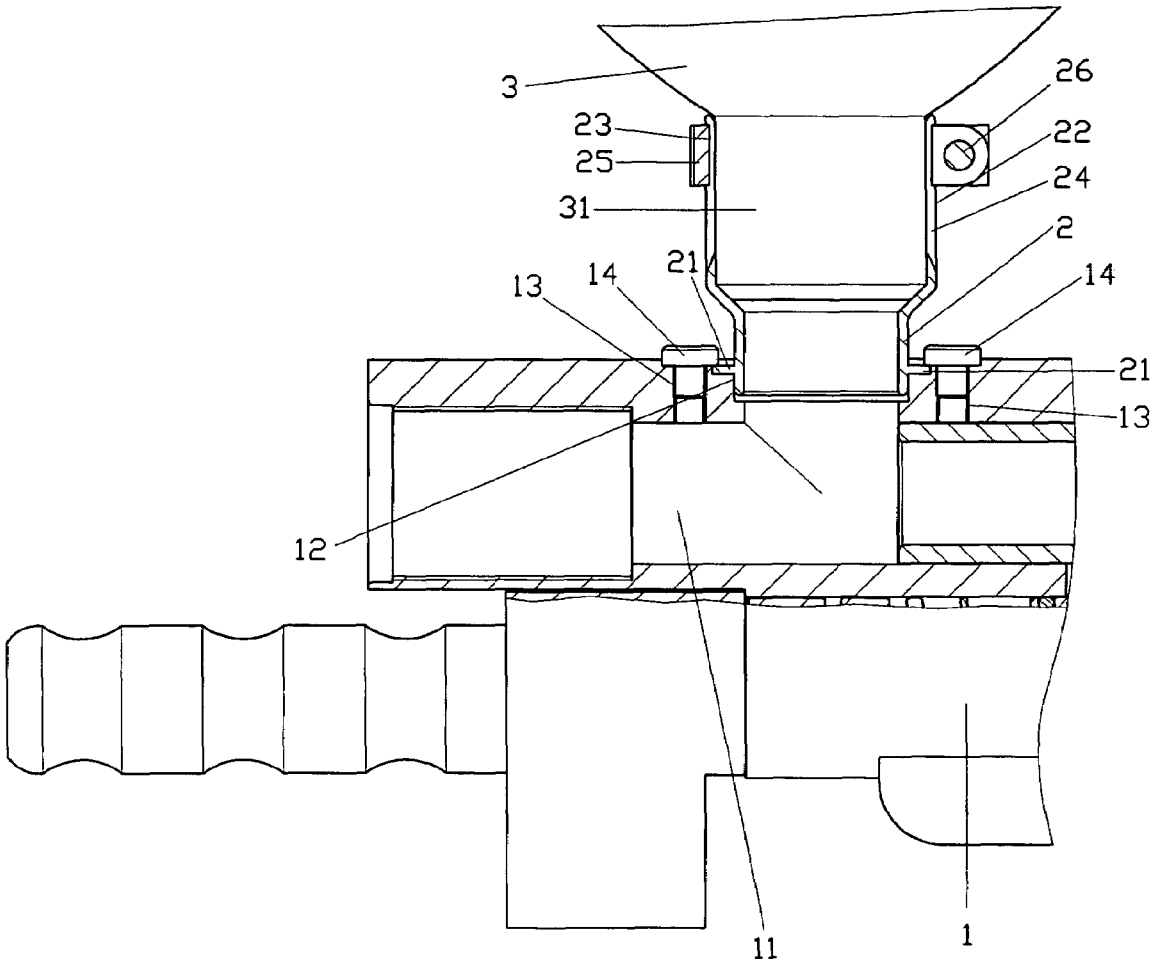
FIG. 2 is a cross-sectional view of the present invention.

As shown in FIG. 1, the present invention comprises a gun body 1, a loading member 2, and a funnel 3.

The gun body 1 comprises an opening 12 on its barrel 11, and a pair of threaded holes 13 at respective sides of the opening 12 for a pair of screws 14 to thread therein.

The loading member 2 is secured to the opening 12 of the barrel 11 with a pair of lugs 21 at respective sides. The upper portion of the loading member 2 has a fixture 22 with a circular trough 23 thereat. A number of slots 24 are formed along the circular trough 23. A clamp 25 is adapted to sleeve on the circular trough 23 by means of a quick-release rod 26 and a nut 27.

The funnel 3 adapted to load with paintballs is secured to the fixture 22 of the loading member 2, and comprises a fixing end 31 at the bottom thereof.

To assemble the present invention, the lugs 21 of the loading member 2 are aligned with the two threaded holes 13 of the gun body 1 and secured with the screws 14. The fixing end 31 of the funnel 3 is placed into the fixture 22 of the loading member 2, and then the clamp 25 is tightened with the quick-release rod 26. This tightens the circular trough 23 and the slots 24 to fasten the funnel 3 into the loading member 2 securely.

Figure 3:
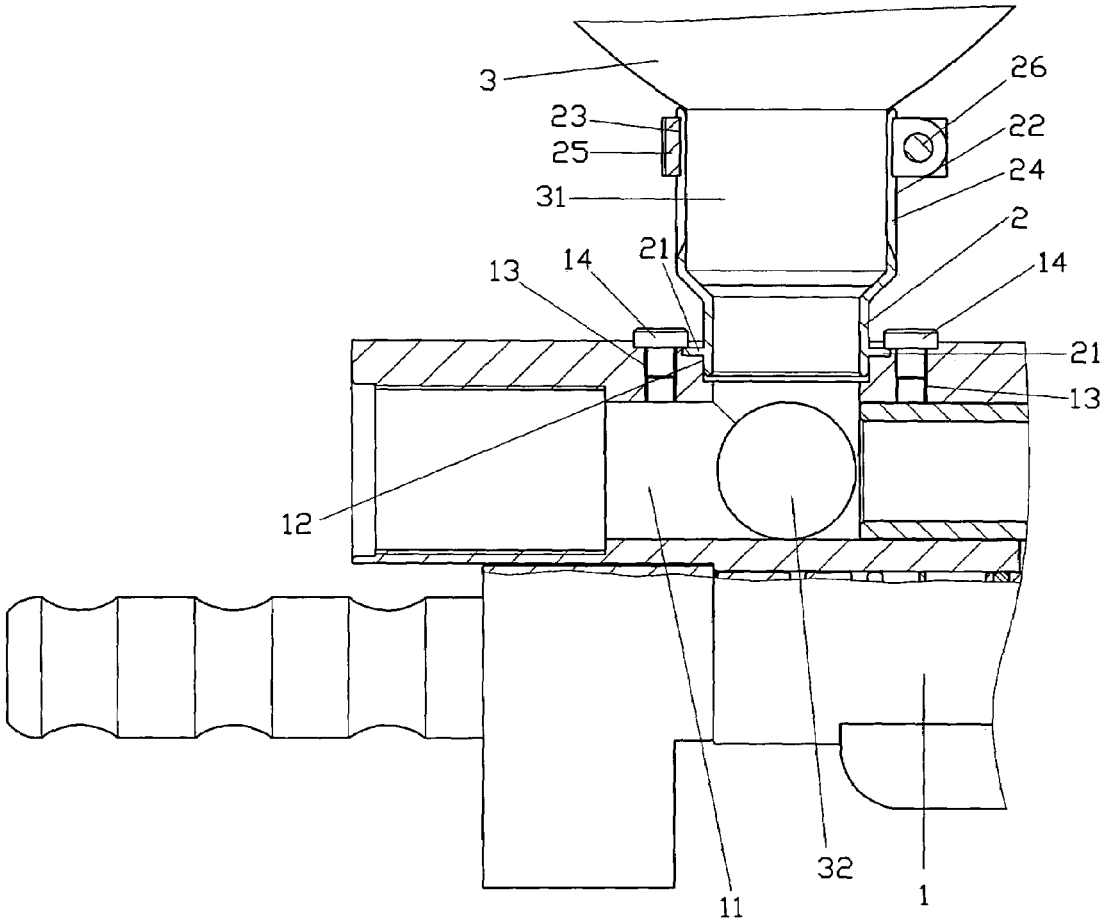
FIG. 3 is a cross-sectional view of the present invention in an operation status.

To operate the paintball gun, as shown in FIG. 3, a paintball 32 in the funnel 3 drops into the barrel 11 through the fixing end 31, the fixture 22 of the loading member 2, and the opening 12 of the gun body 1 for shooting.

Figure 4:
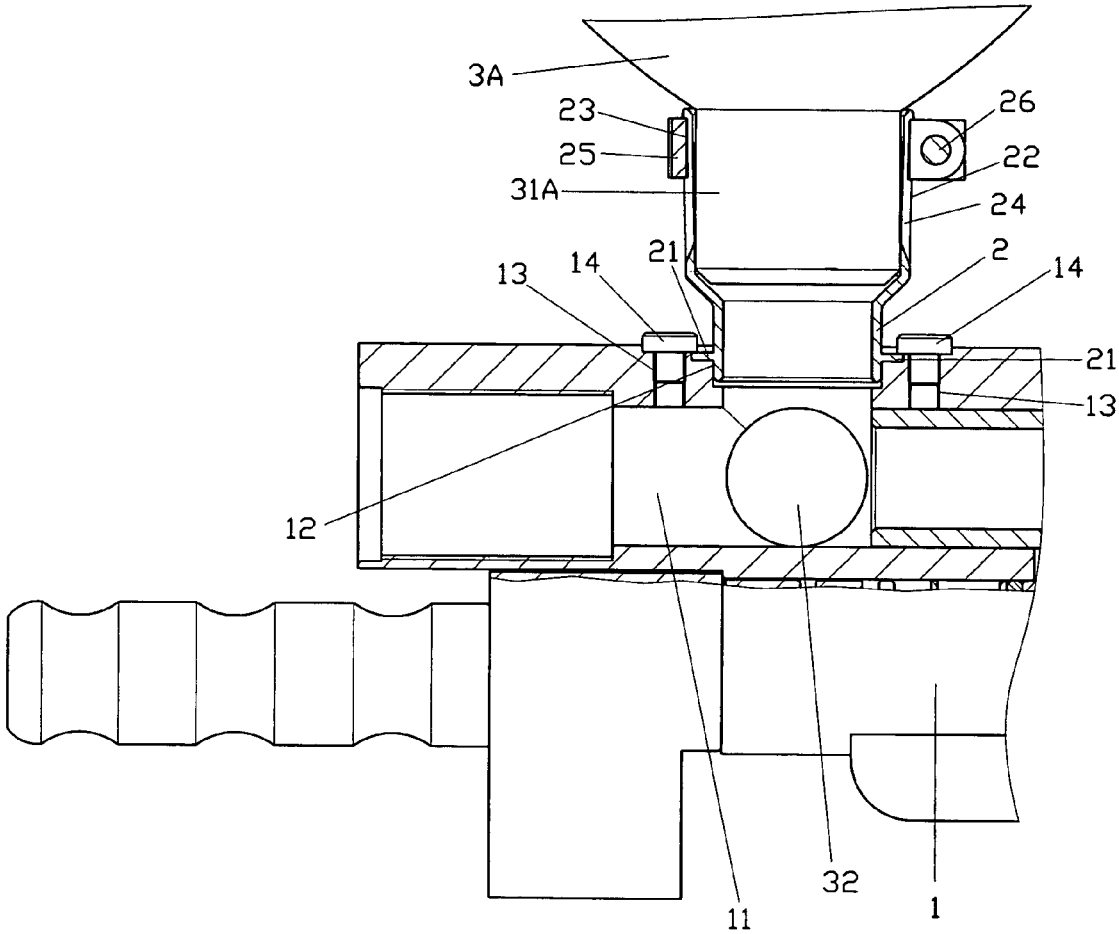
FIG. 4 is a cross-sectional view of the present invention with a different funnel.
Figure 5:
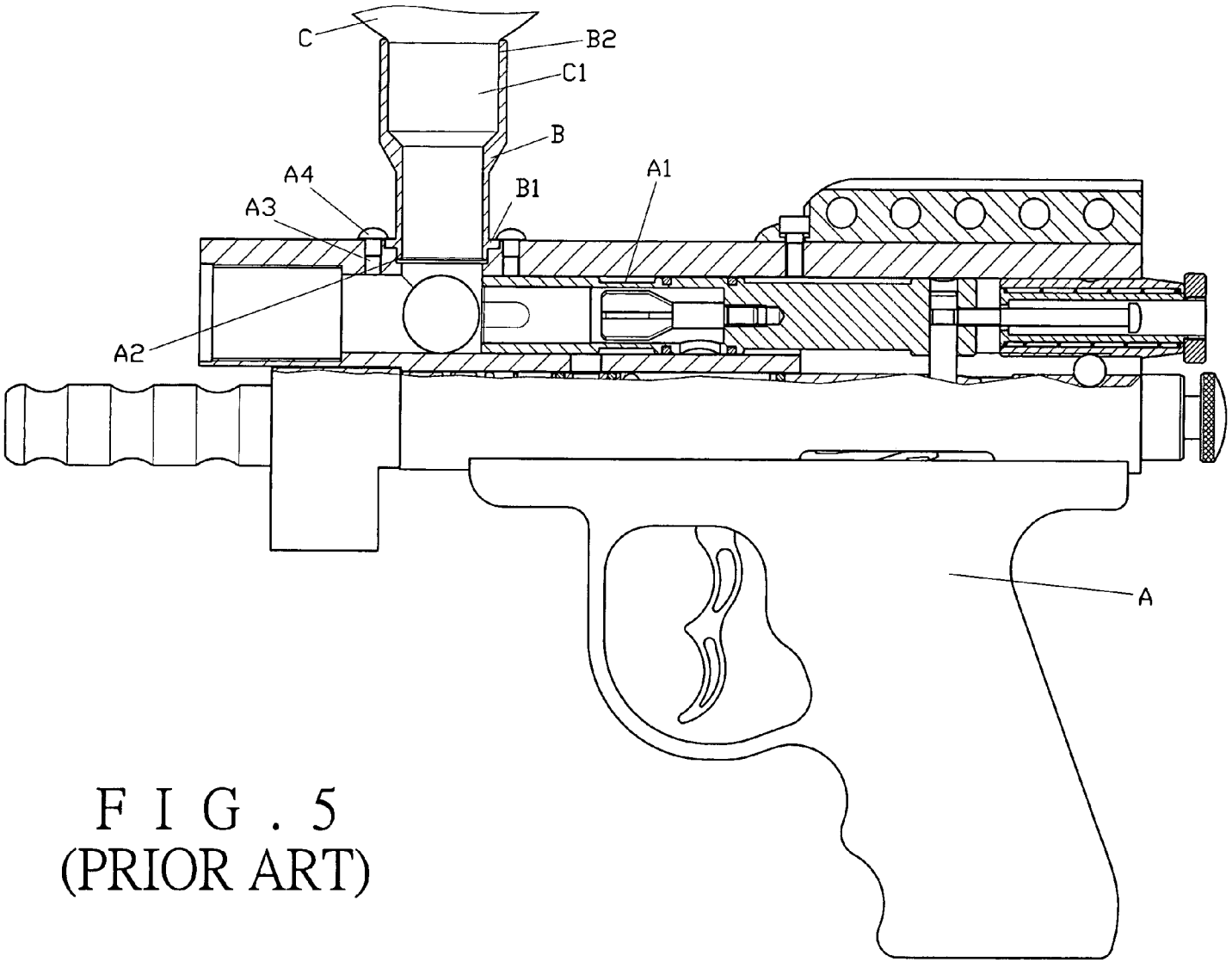
FIG. 5 (PRIOR ART)
FIG. 5 is a cross-sectional view of a prior art.

In case the loading member 2 requires to install a funnel 3A having a fixing end 31A in a different size, as shown in FIG. 4, the quick-release rod 26 of the clamp 25 is loosened, thus the circular trough 23 is released and the fixing end 31 of the funnel 3 may be taken away from the fixture 22 and replaced with the funnel 3A.

What is claimed is:

1. A paintball gun loading device comprising a gun body having an opening, a loading member mounted to said opening of said gun body, and a funnel secured to said loading member, said funnel having a fixing end at the bottom thereof; and characterized in that:

said loading member comprising a fixture at an upper portion thereof, said fixture comprising a circular trough with a plurality of slots along said circular trough, a clamp sleeved on said circular trough being tightened with a quick-release rod and a nut to secure said funnel, said quick release rod being threaded at one end thereof for coupling to said nut and having a lever pivotally coupled to an opposing end of said quick release rod for changing a tension applied to said clamp responsive to displacement of said lever.

* * * * *